United States Patent [19]

Payne, Jr. et al.

[11] Patent Number: 4,832,281

[45] Date of Patent: May 23, 1989

[54] YARN CARRIER STRUCTURE

[75] Inventors: William M. Payne, Jr., Greensboro, N.C.; Joseph Palau, Dvingt, France

[73] Assignee: Burlington Industries, Inc., Greensboro, N.C.

[21] Appl. No.: 72,739

[22] Filed: Jul. 13, 1987

[51] Int. Cl.[4] ..... B65H 75/10; B65H 75/28

[52] U.S. Cl. ..... 242/118.3; 242/18 PW; 242/18 EW; 242/125.1; 242/125.2; 242/131; 242/164

[58] Field of Search ..... 242/118.3, 118.31, 118.32, 242/125, 125.1, 125.2, 125.3, 164, 165, 172, 18 PW, 18 EW, 131, 131.1

[56] References Cited

U.S. PATENT DOCUMENTS

| | | | |
|---|---|---|---|
| 1,924,510 | 8/1933 | Parks | 242/125.2 |
| 3,246,855 | 4/1966 | Preston | 242/164 X |
| 3,283,489 | 11/1966 | Bakker | 242/165 X |
| 3,350,032 | 10/1967 | Schewe | 242/164 |
| 3,356,312 | 12/1967 | Briggs et al. | 242/164 |
| 3,356,313 | 12/1967 | Johnson et al. | 242/165 |
| 3,420,467 | 1/1969 | Bell | 242/164 X |
| 3,625,451 | 12/1971 | Anderson | 242/125.1 |
| 3,664,602 | 5/1972 | Renzi | 242/131 |
| 3,677,492 | 7/1972 | Ueda et al. | 242/164 |
| 3,955,775 | 5/1976 | Egyptien et al. | 242/125.1 |
| 3,986,680 | 10/1976 | Cardell | 242/125.1 |
| 4,005,567 | 2/1977 | Mariani | 242/125.2 X |
| 4,025,002 | 5/1977 | Sutton, III et al. | 242/165 X |
| 4,050,646 | 9/1977 | Burchette, Jr. | 242/125.1 |
| 4,063,696 | 12/1977 | Kelly et al. | 242/125.1 |
| 4,065,073 | 12/1977 | Rohner | 242/131 |
| 4,084,767 | 4/1978 | Witt | 242/164 |
| 4,094,476 | 6/1978 | Schmidt et al. | 242/125.2 |
| 4,101,086 | 7/1978 | Thomas, Jr. | 242/18 PW |
| 4,154,409 | 5/1979 | Reisser et al. | 242/125.1 X |

FOREIGN PATENT DOCUMENTS

| | | | |
|---|---|---|---|
| 136256 | 6/1979 | Fed. Rep. of Germany | 242/164 |

*Primary Examiner*—Stanley N. Gilreath

*Attorney, Agent, or Firm*—Cushman, Darby & Cushman

[57] ABSTRACT

A yarn carrier structure upon which yarn is wound to form a yarn package includes an axially extended body having a cylindrical exterior surface formed about an axis and a through opening having at least first and second opposed surfaces for engagement by the fingers of a yarn package manipulating machine. Yarn entry ports are provided at one end of the yarn carrier structure and lead to internal passages for accepting and accommodating the leading and transfer tails of the yarn wound upon the yarn carrier structure. First and second slots are provided in the yarn carrier structure to facilitate mounting of the carrier on a utilizing machine. The position of the engagement and mounting surfaces relative to the yarn entry ports are known to provide a yarn carrier structure well suited for automatic machine manipulation.

55 Claims, 5 Drawing Sheets

YARN CARRIER STRUCTURE

BACKGROUND OF THE INVENTION

The present invention relates to yarn packages as used in the textile industry and, more particularly, to yarn carrier structures upon which yarn is wound to form a yarn package.

In the textile industry, yarn is handled by winding a predetermined quantity of yarn upon a core structure to form a yarn package that can be readily transported, stored, processed, and mounted onto and demounted from yarn processing machines and handling equipment. To date, industry-wide dimensional and configuration standards have not evolved for yarn carrier structures. In general, the core or carrier structures are configured as a hollow cylinder or cone upon which the yarn is wound and fabricated from various types of plastics, wire mesh, or paper-like materials. While the exterior profile of the yarn carrier structure varies widely, yarn carriers all have some type of central opening that allows the yarn package to be placed onto and removed from shafts and 'pins' used throughout the industry to mount yarn packages. Regardless of the particular yarn carrier configuration and the manner by which the yarn is wound upon the exterior of the carrier, it is important that the leading and trailing ends of the yarn package be accessible to the user to facilitate the mounting of the yarn package onto various machines and the feeding or threading of the yarn into the machine. For example, in the beaming of warp yarns, a large number of yarn packages are mounted on a creel with the yarn from each yarn package wound about the beam. Prior to the yarn from an 'active' yarn package being exhausted, an attendant mounts a replacement yarn package adjacent the active package and knots or splices the trailing end of the active yarn package to the leading or beginning end of the replacement yarn package. When the active yarn is depleted, yarn will then be delivered from the replacement package which then functions as the active yarn package. This creeling procedure requires that the operator be able to reliably locate both the trailing end of the currently active yarn package and the leading end of the replacement yarn package to effect the desired knotting or splicing operation.

In a majority of textile environments, no formal means is provided to locate the leading end of the yarn its location being random on the outer surface of the yarn package. The trailing end of the yarn, normally referred to as the transfer tail, consists of a short segment of yarn that may or may not be wound around the base of the yarn package, aside of and apart from the main body of the yarn package.

Various techniques have been used to assist the operator in locating yarn ends. In more sophisticated arrangements, one end of the yarn carrier tube is provided with yarn receiving grooves, slots, or notches to assist in retaining the transfer tail in place. For example, in U.S. Pat. No. 1,924,510 to Parks, chordal slots are cut in an axial end face of the yarn tube with a portion of the transfer tail segment placed within the slots. Additionally, cutouts or relieved portions are provided in the end face of the yarn tube to allow an attendant to readily grasp the yarn end captured within the slot. In other arrangements, as represented in U.S. Pat. No. 4,005,567 to Mariani, a simple tab is provided on the circumferential surface of the yarn tube with a segment of the transfer tail wedged beneath the tab to secure the yarn end in place. In addition to securing the yarn end to the yarn tube, the yarn end has been retained in an auxiliary structure. As shown in U.S. Pat. No. 4,065,073 to Rohner, a wheeled yarn package cart is provided with a plurality of hollow, open-ended pins upon which the individual yarn packages are mounted. The pins are connected to a sub-ambient pressure source and function as suction tubes into which a yarn end is inserted and retained in place.

While conventional yarn package structures have been reasonably well-suited for the manipulation of yarn in the textile industry, considerable labor is required to load and unload the yarn packages throughout textile manufacturing processes with each package loading often requiring the finding and manipulation of the yarn ends. It would be advantageous to be able to eliminate this labor requirement by automation of these functions.

While progress has been made in lowering the labor content of many aspects of the textile manufacturing industry, the disparate nature of yarn carrier structures and yarn packages, as they have evolved, represent a formidable challenge to the automatic machine manipulation of yarn packages, particularly where the machine must also reliably locate the leading and trailing yarn ends of each yarn package.

SUMMARY OF THE INVENTION

In view of the above, it is a principal object of the present invention, among others, to provide a yarn carrier structure for forming yarn packages which provides a standard configuration well suited for automatic machine manipulation.

It is another object of the present invention to provide a yarn carrier structure having a standard mounting surface configuration for mounting the yarn carrier on a support structure or machine.

It is another object of the present invention to provide a yarn carrier structure having a standard surface configuration that allows engagement of the yarn carrier by a machine tool.

It is another object of the present invention to provide a yarn carrier structure for a yarn package in which the leading and trailing yarn ends are reliably retained at predefined positions.

It is a further object of the present invention, to provide a yarn carrier structure for a yarn package in which the yarn ends are reliably retained in known relationships relative to a surface configuration by which the yarn carrier can be engaged and manipulated by a machine and a surface configuration by which the yarn carrier can be mounted upon a support structure.

In view of these objects, and others, the present invention provides a yarn carrier structure having an exterior surface upon which yarn is wound, a yarn end retaining structure by which at least one yarn end of a yarn package is reliably retained in a predetermined location, and a surface configuration which allows for the engagement of the yarn carrier by a machine for the manipulation of the yarn package and which allows the mounting of the yarn carrier on a utilizing structure in such a way that the positional relationship of at least one yarn end is known.

In one form of the invention, a yarn carrier structure is defined as a hollow body having an exterior surface of revolution about a common axis and upon which yarn is wound. The interior of the hollow body is provided with at least first and second opposed surfaces which can be gripped by the laterally extensible fingers of an engaging tool. Yarn entry-ports are provided on an axial or circumferential surface of the body for accepting the leading and trailing yarn ends of the wound yarn. The yarn entry ports each lead to respective internal passages which accept and reliably retain the yarn ends in a known position relative to the first and second engagement surfaces so that the position of the retained yarn ends is known once the yarn carrier is engaged by its first and second opposed engagement surfaces. Mounting surfaces in the form of slots are formed in the yarn carrier in a predetermined relationship relative to the yarn ports so that the position of the retained yarn ends is known once the yarn carrier is mounted upon a suitable support structure.

In a preferred embodiment, the yarn carrier structure is formed about a central axis as an axially extended hollow body that includes a cylindrical surface of revolution about which yarn is wound. The body is formed with a through bore having a trapezoidal cross section with the parallel opposed sides of the through bore adapted to be engaged by laterally movable fingers of a yarn package engaging tool. Yarn end entry-ports are provided at one end of the body and lead to interior passages that receive and retain the yarn ends therein. The interior passages are preferably formed as a helix about the central axis to accommodate yarn ends having a length greater than the axial length of the yarn carrier structure. The internal passages may be defined by helically formed internal grooves or channels or by flexible, plastic tubing contained within the yarn carrier structure and aligned in a generally helical path. Mounting slots are formed in the circumferential surface of the yarn carrier structure along parallel chords to allow mounting of the yarn carrier structure in a creel or other yarn package utilizing machines including yarn package transportation and storage devices. In accordance with other features of the present invention, machine readable indicia are provided on the yarn carrier structure to allow one or more sensors of an automatic yarn handling machine to scan the indicia and engage the yarn carrier structure in a predetermined orientation. In addition, yarn end engaging pads, such as 'Velcro' type fasteners, are provided on the yarn carrier structure as an aid for releasably engaging yarn ends.

The yarn carrier is designed to be mounted upon a yarn package mounting structure, such as a creel, which is provided with slot-like openings for accepting the yarn carrier structure. The mounting system allows for the reliable mounting of the yarn carrier structure on its receiving structure in such a manner that the position of the retained yarn ends can be readily ascertained.

In addition to forming the yarn carrier structure as a complete full-function component, a yarn carrier adaptor can be fabricated for modifying a conventional yarn tube, cone, or bobbin to provide the desired functions in accordance with the present invention.

The present invention advantageously provides a yarn carrier structure well-suited for automated machine handling, including engagement and manipulation by a multi-axis arm having sensor equipped tooling in which the positional relationship of the yarn ends is. known to allow reliable yarn end detection and manipulation. The pre-defined engagement surfaces allow the yarn carrier structure to be engaged in a uniform manner, the positioning of the yarn end ports in a known relationship relative to the engagement surfaces allows reliable detection of the yarn ends, and the use of predetermined mounting surfaces allow consistent mounting of the yarn package in such a way that many functions formerly associated with yarn package handling can be performed by automatic machinery including programmed-controlled robots.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
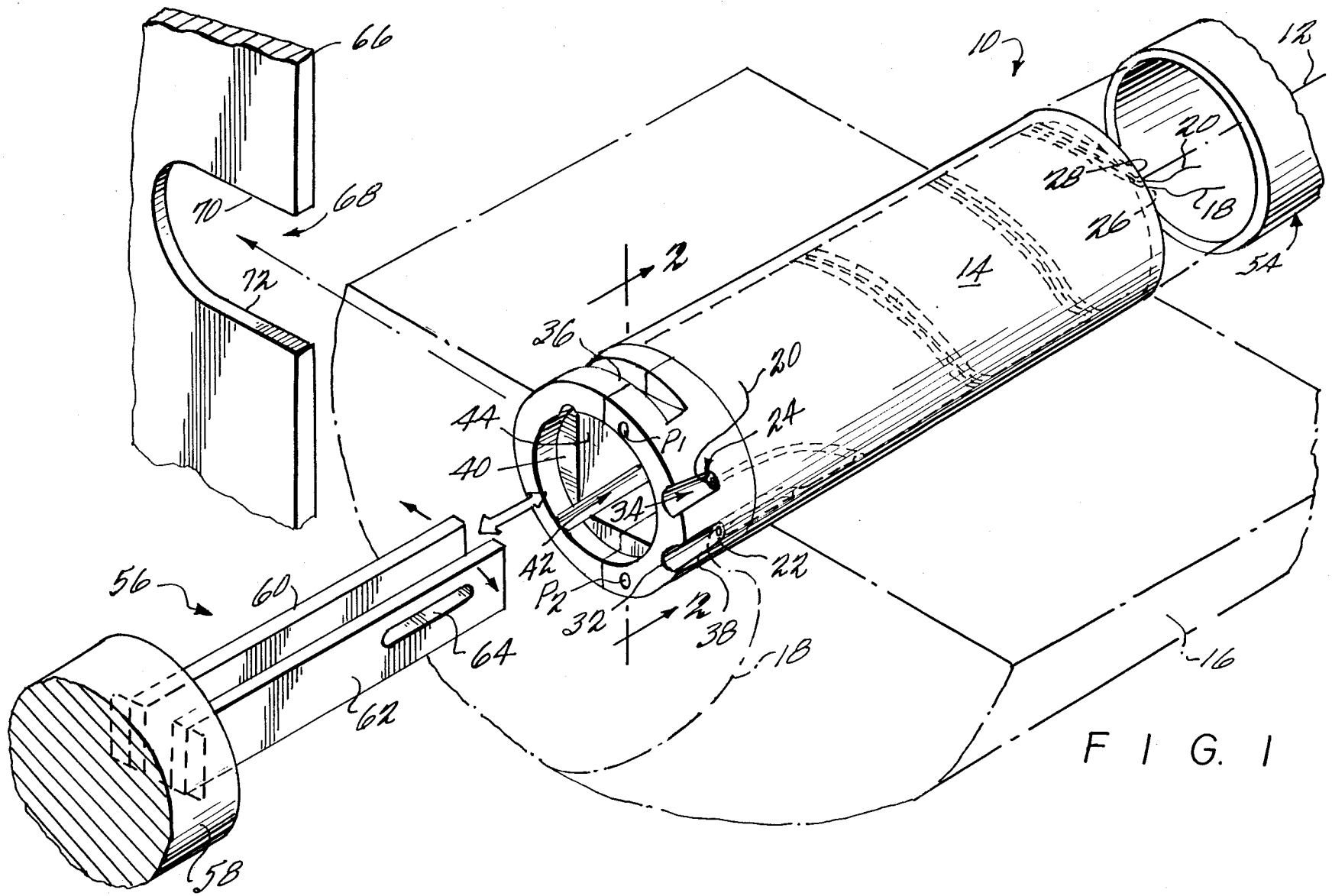
FIG. 1 is an isometric view of a yarn carrier in accordance with the present invention and a tooling assembly for engaging and manipulating the yarn carrier.

A yarn carrier structure in accordance with the present invention is shown in FIG. 1 and designated generally therein by the reference character 10. As shown, the yarn carrier 10 is formed as a body of revolution about an axis 12 and includes a cylindrical surface 14 upon which yarn is wound to form a yarn mass 16 (dotted line illustration). The yarn carrier 10 includes a first yarn entry port 22 and second yarn entry port 24 located at a first end of the yarn carrier 10. As shown, a leading yarn end 18 is received within the first yarn entry port 22, and a trailing yarn end 20 is received within the second yarn entry port 24. As explained more fully below, the leading yarn end 18 and the trailing yarn end 20 are contained within internal passages or cavities in the yarn carrier 10 and exit the yarn carrier 10 at a first exit opening 26 and a second exit opening 28, respectively, at the second end of the yarn carrier 10. Both the first yarn entry port 22 and the second yarn entry port 24 have respective conically tapered entry ways 32 and 34 that lead to the yarn entry ports and assist in guiding the yarn ends into their respective entry ports, as explained below. In the embodiment illustrated the yarn entry ports 22 and 24 are formed on the same radii from the axis 12 and are separated by approximately 45° or so, although other angular spacings are equally suitable.

Figure 2:
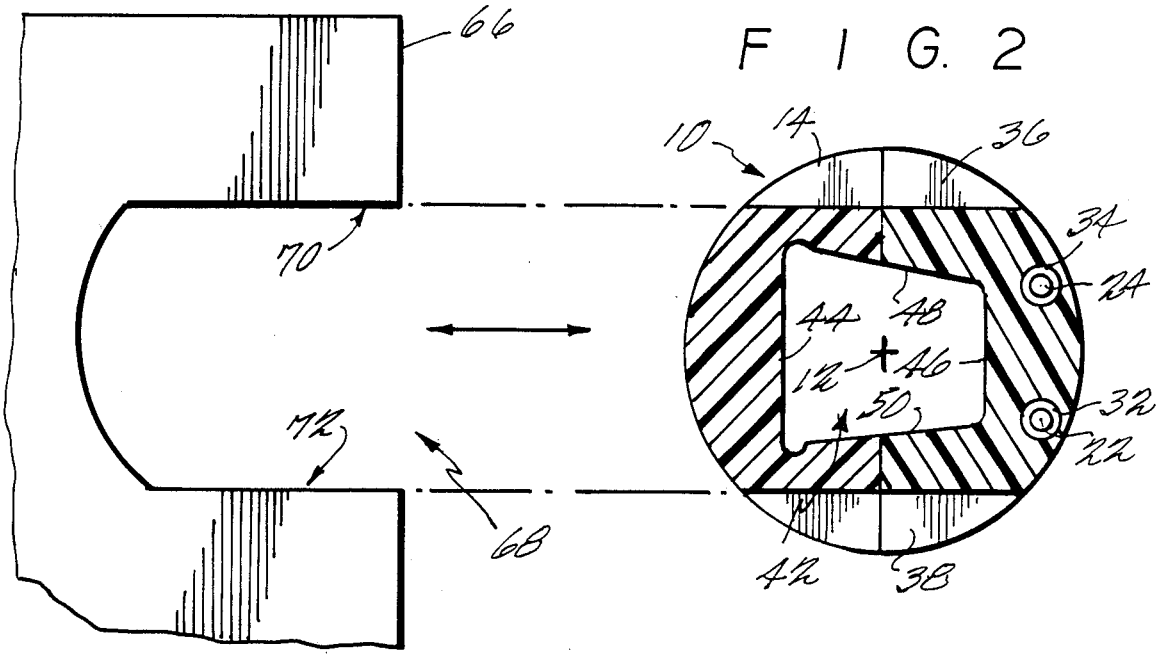
FIG. 2 is a cross-sectional view of the yarn carrier taken along line 2—2 of FIG. 1.

As shown in FIGS. 1 and 2, the yarn carrier 10 is provided with a pair of mounting slots 36 and 38 formed along spaced parallel chords adjacent the first end of the yarn carrier 10. The alignment of the slots 36 and 38 is substantially perpendicular to a line drawn through the entry ports and 22 and 24 thereby assuring a known positional relationship between the mounting slots 36 and 38 and the entry ports 22 and 24. The mounting slots 36 and 38 are used to mount the yarn carrier 10 upon a creel or similar structure, as explained more fully below. The yarn carrier 10 is formed with a counterbore 40 at its first end for engagement with other components including machine shafts, the mounting nubs of reusable yarn package shipping containers, and the like. An internal opening 42 extends along the axial length of two sub-components, described more fully below, of the yarn carrier 10. As shown in FIG. 2, the internal opening 42 has a trapezoidal cross section and includes a first side wall 44, a somewhat shorter second side wall 46 spaced from and generally parallel to the first side wall 44, and mutually inclined connecting walls 48 and 50. The side wall 44 is formed parallel to a line extending between the first and second yarn entry ports 22 and 24 so that the positional relationship between the side wall 44 and the yarn entry ports 22 and 24 is known.

At least one and preferably more recesses or indentations 52 (FIG. 3) are formed on the first and second side walls 44 and 46 with indicia (not specifically shown), such as machine readable bar codes, located in the indentations 52. Preferably, each indentation 52 is provided with a unique bar code identifying the yarn carrier 10 and also identifying which of the four indentations 52 of the yarn carrier 10 is being read. This indicia system permits identification of the end of the yarn carrier 10 that is being entered by a stored-program controlled tool, as described below, and the determination of the precise orientation of the yarn carrier 10.

The leading yarn end 18 and the trailing yarn end 20 from the yarn mass 16 are either manually or automatically inserted into their respective yarn entry ports 22 and 24 and threaded through their below described passages to the exit openings 26 and 28. While various methods can be used to thread the yarn ends through their respective yarn passages, a vacuum induction process is preferred. As shown in FIG. 1, a conduit 54, connected to a vacuum source (not shown), is coupled to the exit opening end of the yarn carrier 10 and induces an air flow from the entry ports 22 and 24, through the yarn passages, to the yarn exit openings 26 and 28 with this flow sufficient to thread the leading yarn end 18 and the trailing yarn end 20 through their respective yarn passages to the exit openings 26 and 28 where excess yarn may be trimmed.

If desired, releasable yarn engagement pads $P_1$ and $P_2$ (FIG. 1) are provided on an axial end face of the yarn carrier structure 10. The yarn engagement pads $P_1$ and $P_2$ may take the form of fabric backing pads having short, resilient filament hooks, for example, as sold under the trademark 'Velcro'. The yarn engagement pads $P_1$ and $P_2$ serve to releasably engage a yarn end or ends during handling and manipulation of the yarn carrier structure 10 and are useful as temporary storage locations for the yarn ends during preliminary manual handling. The yarn engagement pads $P_1$ and $P_2$ may be adhesively secured to the axial end face of the yarn carrier structure 10 or shallow counterbores (not shown) may be formed into which the yarn engagement pads $P_1$ and $P_2$ are positioned. The placement of the yarn engagement pads $P_1$ and $P_2$ shown in FIG. 1 is exemplary only, as can be appreciated, yarn engagement pads can be mounted at other locations on the yarn carrier structure 10.

The yarn carrier 10 is adapted to be engaged and manipulated by a multi-axis, articulatable arm (not specifically shown) having an end-of-arm tooling assembly indicated in general form at 56 in FIG. 1. The tooling assembly 56 includes a schematically represented base member 58 having a first finger 60 and second finger 62 with a sensor 64, such as a bar code reader, mounted within appropriately formed cavities in the outwardly facing surface of the finger 62. The sensor 64 is designed to read the indicia positioned within the indentations 52, described above, in the first and second side walls 44 and 46 of the internal opening 42 of the yarn carrier 10. The first finger 60 and the second finger 62 are movably mounted on the base member 58 for lateral movement toward and away from one another. When the first finger 60 and the second finger 62 are moved adjacent one another, viz., in a collapsed position, the fingers 60 and 62 can be inserted into the internal opening 42 until the base member 58 engages the first end of the yarn carrier 10. The first and second fingers 60 and 62 are then laterally separated to an expanded position in which the first finger 60 contacts the first side wall 44 and the second finger 62 contacts the second side wall 46 with sufficient force to firmly 'grip' the yarn carrier 10. When the yarn carrier 10 is gripped by the tooling assembly 56, the positional relationship of the yarn entry ports 22 and 24 relative to the fingers and 62 is ascertainable because of the dimensional relationships discussed above. In this situation, the articulatable arm can then be operated, for example, by a stored-program controller, to move the yarn carrier 10 from one position to another on a yarn utilizing machine or from one machine or device to another.

As shown in FIGS. 1 and 2, the yarn carrier 10 is part of a yarn carrier mounting system by which the yarn carrier 10 can be conveniently mounted upon and demounted from a support structure in such a way that the positional relationship of the yarn entry ports 22 and 24 relative to the mounting structure is known or otherwise determinable. As shown, the end-of-arm tooling assembly 56 is used to mount and demount the yarn carrier 10 in a mounting structure 66, which can be part of a yarn creel or a bulk handling/storage device for storing or transporting multiple yarn carriers. The mounting structure 66 includes an opening 68 having first and second spaced parallel mounting edges 70 and 72 that are accepted within the first and second mounting slots 36 and 38. When the yarn carrier 10 is mounted in the manner described, the positional location of the yarn mass 16, the leading yarn end 18, and the trailing yarn end 20 are known. While the described yarn carrier 10 is designed for mounting and demounting from a mounting structure 66 that includes a carrier accepting opening 68, as shown in FIGS. 1 and 2, the yarn carrier 10 can also be mounted upon cylindrical pins commonly used throughout the industry on yarn package transport/storage equipment. In addition, the yarn carrier 10 is well-suited for mounting upon members having a "T" shaped cross-section, as disclosed in commonly assigned and co-pending U.S. patent application Ser. No. 826,573, filed Feb. 6, 1986, the disclosure of which is incorporated herein by reference.

Figures 3, 3A, 3B:
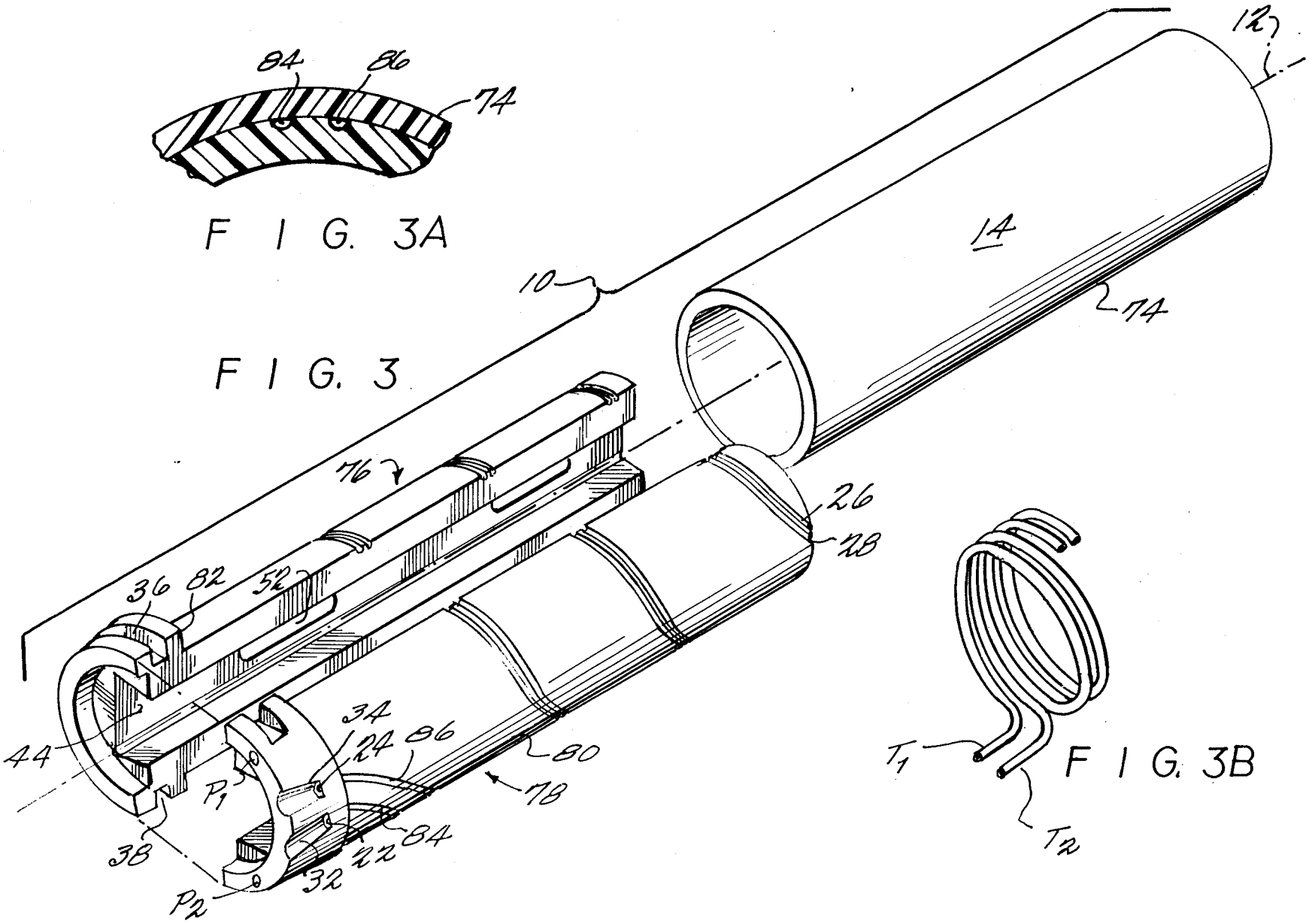
FIG. 3 is an exploded isometric view of the component parts of the yarn carrier of FIG. 1.
FIG. 3A is a detailed cross-sectional view of adjacent yarn passages in the yarn carrier.
FIG. 3B is an isometric view of a pair of hollow plastic tubes aligned along a helical path for use with the embodiment of FIG. 3.

As shown in FIG. 3, the yarn carrier 10 is formed as an assembly from sub-components preferably manufactured from a plastic or other moldable material. The yarn carrier 10 includes a hollow, cylindrical sleeve 74 and first and second complementary halves 76 and 78 which abut one another along a diameter plane to form a complete core assembly having a reduced diameter cylindrical surface 80 extending from the second end of the yarn carrier 10 to a shoulder 82. First and second yarn channels or passageways 84 and 86 are formed in the surface of the complementary halves 76 and 78 and follow a generally helical path about the axis 12 from the yarn entry ports 22 and 24 to the yarn exit openings 26 and 28 with three full turns about the axis 12 being provided in the disclosed embodiment. As is apparent, the path length of the passageways 84 and 86 should be sufficient to hold sufficient lengths of yarn as required for the leading ends and the transfer tails for the creels on which the yarn carrier 10 will be utilized.

The yarn carrier 10 is assembled by mounting the complementary halves 76 and 78 together and inserting the abutting complementary halves into the sleeve 74. An interference fit between the components can be provided to maintain structural integrity or, if preferred, the components can be secured together using a suitable cement or adhesive. As shown in FIG. 3A, the passageways 84 and 86 cooperate with the inside diameter surface of the sleeve 74 to define closed yarn receiving passages extending between the two ends of the yarn carrier 10. In general, the path length of the yarn passages is longer than the axial length of the yarn carrier 10 to retain yarn ends that are sufficiently long to allow threading into yarn utilizing machinery or splicing to another yarn end. In one embodiment, a yarn carrier 10 having an axial length of 12 inches or so is provided with a yarn passage length of approximately 30 inches. In general, the path length of the yarn passages should be determined by the creel configurations independent of the length of the yarn carrier 10. The axial length of the cylindrical surface 80 is preferably less than the length of the sleeve 74 to define a counter bore (not specifically shown) at the second end of the yarn carrier, the counter bore suitable for engaging machine shafts and the mounting nubs of yarn package shipping containers commonly used in the industry.

In addition to defining the yarn passageways 84 and 86 as channels or grooves that are molded as part of or machined into the surface 80 of the complementary halves 76 and 78, elongated plastic tubes $T_1$ and $T_2$, as shown in pictorial form in FIG. 3*b*, can be fitted into the channels. In general, the use of plastic tubing is preferred since the interior surface finish and the low surface friction coefficient of the plastic tubing diminishes the need for precision molded or machined channels in the surface 80.

Figure 4:
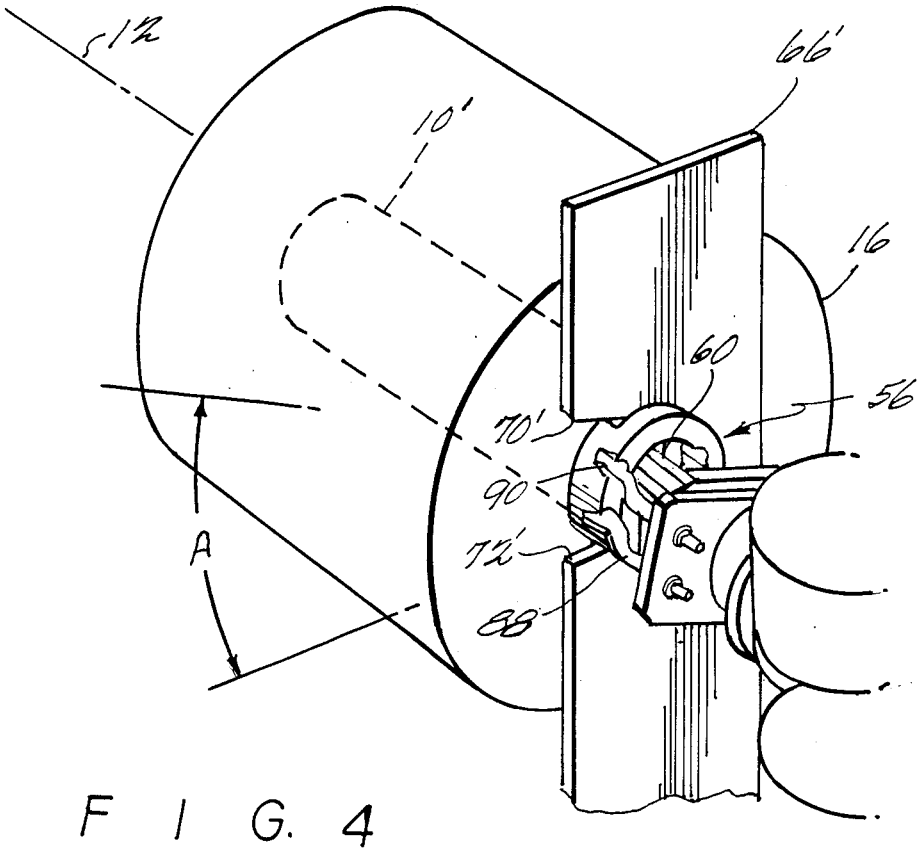
FIG. 4 is a view of the yarn carrier of FIG. 1 being mounted by a tooling assembly upon a slotted creel structure.

FIG. 4 illustrates the mounting of a modified yarn carrier 10′ on a modified mounting structure 66′ using the tooling assembly 56 equipped with pneumatic suction tubes 88 and 90 for removing the leading yarn end 18 and the trailing yarn end 20 from their respective passageways. The articulatable arm (not shown) upon which the tooling assembly 56 is mounted is preferably operated in response to a pre-programmed controller to align the mounting slots 36 and 38 with the opening defined by mounting surfaces edges 70′ and 72′ and place the carrier 10′ into its mounted position. Once the yarn carrier 10′ is mounted in place, the fingers 60 and 62 are moved toward one another to release the yarn carrier 10′. Depending upon the specific operation involved, one of the suction tubes 88 and 90 are activated to withdraw the respective yarn end from its passageway as the fingers 60 and 62 are retracted from the internal opening 42. The yarn carrier 10′ and the mounting structure 66′ of FIG. 4 vary from that of FIGS. 1–3 in that the mounting surface edges 70′ and 72′ are formed at an angle "A" relative to one another with alignment of the mounting slots 36 and 38 of the yarn carrier 10′ modified to accommodate the receiving opening 68′.

Figure 5:
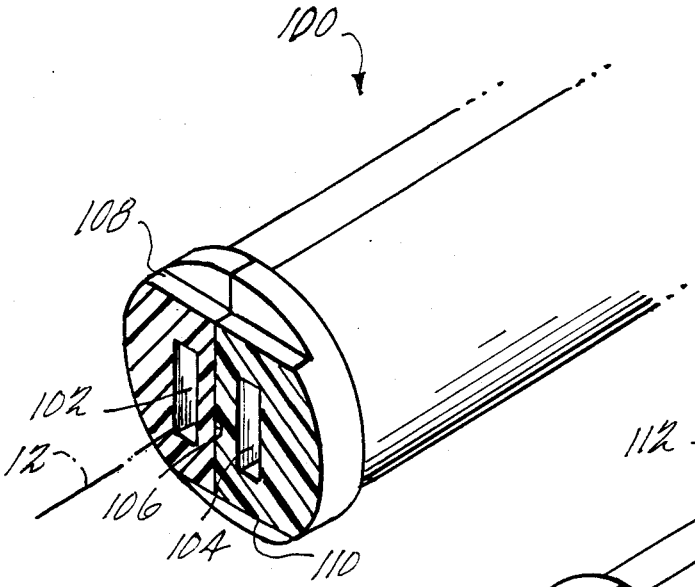
FIG. 5 is an isometric view of a portion of a modified yarn carrier having a mounting surface and engagement surface configuration different from that shown in FIGS. 1–4.

While the yarn carrier 10 of FIGS. 1–3 represents a preferred form of the invention, other variations are equally suitable. For example and as shown in FIG. 5, a modified yarn carrier 100 is provided with two spaced parallel rectangular openings 102 and 104 separated by an intermediate partition 106. The internal openings 102 and 104 are each adapted to receive a respective finger of the tooling assembly 56 (FIG. 1) which engages the yarn carrier 100 by gripping the partition 106 between the fingers 60 and 62. The yarn carrier 100 is provided with a pair of mounting slots 108 and 110 formed along parallel chords that are in a non-perpendicular relationship with the longer sides of the rectangular openings 102 and 104.

Figure 6:
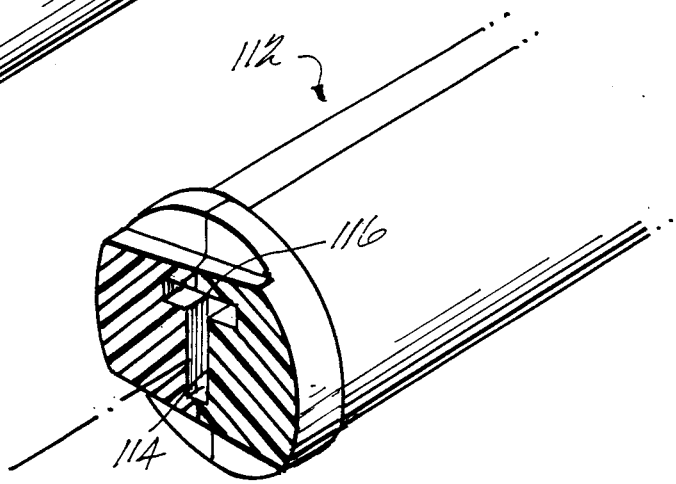
FIG. 6 is an isometric view of a portion of another modified yarn carrier having another mounting surface and engagement surface configuration.

A further variation of the yarn carrier 10 of FIGS. 1–3 is shown in FIG. 6 and designated by the reference character 112. As shown, the yarn carrier 112 includes a first opening 114 and a generally perpendicular second opening 116 to define a generally 'T'-shaped engagement surface configuration. As can be appreciated, the alignment of the two fingers of the tooling assembly 56 is changed to accommodate the 'T'-shaped engagement surface configuration.

Figure 7:
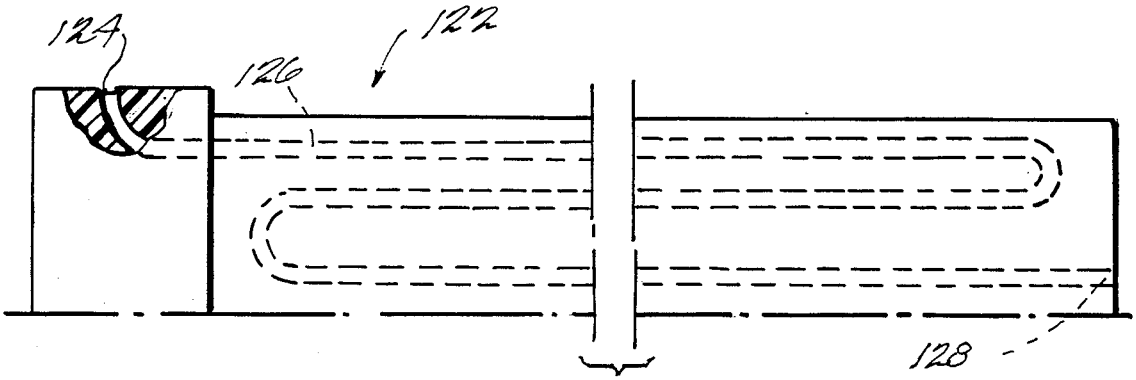
FIG. 7 is a schematic representation of a yarn carrier having an alternate yarn end retaining path.

In addition to the axial alignment of the yarn entry ports and the helical yarn passageways presented with the embodiment of FIGS. 1–3, other yarn entry port and yarn passageway configurations are suitable. For example and as shown in FIG. 7, a yarn carrier 122 includes a yarn entry port 124 that is radially aligned relative to the axis 12 and which leads to a yarn passageway 126 that follows a sinuous path to the yarn exit opening 128.

In the illustrated embodiment, the cylindrical sleeve 74 upon which the yarn is wound has been presented as an integral component of the yarn carrier structure. As can be appreciated, the function of the sleeve can be preformed by yarn tubes as commonly used in the industry with the core halves 76 and 80 functioning as an adaptor-type insert. In this regard, the core assembly can be inserted into a yarn tube and is therefor retained in place using suitable adhesives or other connecting devices to maintain the parts in their assembled relationship.

Figure 8:
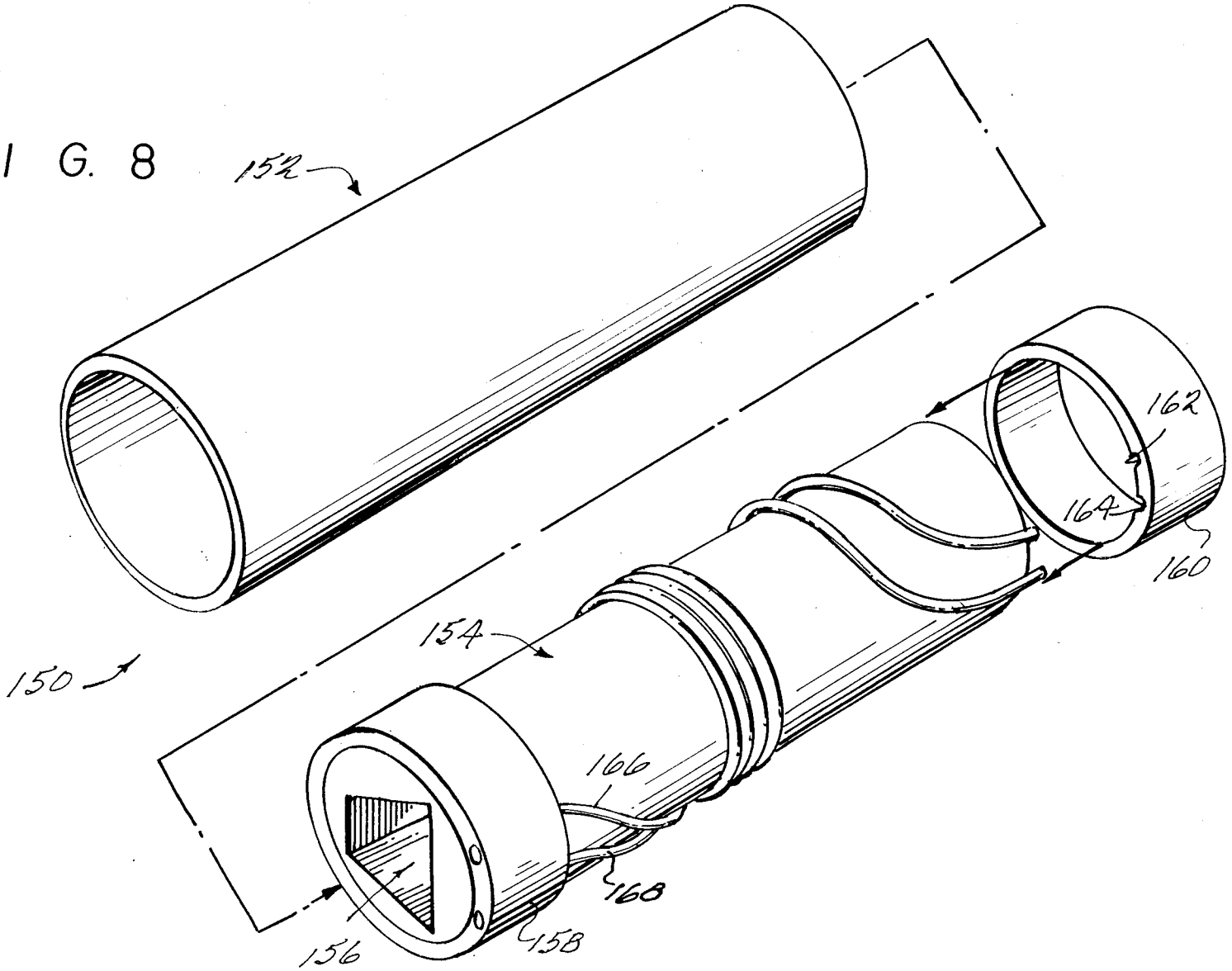
FIG. 8 is an exploded isometric projection of another embodiment of the present invention.

Another embodiment of the present intention is illustration in FIG. 8 and designated generally by the reference character 150. The yarn carrier structure 150 is manufactured from cellulose-based cardboard products and plastic to provide a yarn carrier structure that performs in accordance with the present invention and can be inexpensively manufactured. As shown in FIG. 8, the yarn carrier structure 150 is formed from a hollow, cylindrical outer tube 152 and an inner tube 154 coextensive in length with the outer tube 152. The outer tube 152 formed from plural layers or helically wrapped paper to form a strong, thin-walled, and inexpensive tube. In a similar manner the inner tube 154 is molded from a cellulose particle material to form an inexpensive, lightweight component. The inner tube 156 is formed with an internal through passage 156 having the desired engagement surfaces as described above. Annular end rings 158 and 160 formed, for example, from molded plastic, are designed to slip over the opposite ends of the inner tube 154 and retained in place with a suitable adhesive or cement (not shown). The end rings 158 and 160 are each provided with internal grooves 162 and 164 that serve to capture the opposite ends of flexible plastic tubes 166 and 168 wound about the outside diameter of the inner tube 154. The plastic tubes 166 and 168, as can be appreciated, define the yarn passageways with the opposite, open ends of the tubes 166 and 168 functioning as the respective yarn entry ports and yarn exit openings as described above. The outer tube 152 fits over the outside diameter surfaces of the end rings 158 and 160 to constrain the plastic tubes 166 and 168 in place. The outer tube 152 is adhesively secured to the end rings 158 and 150 to define the assembled yarn carrier structure 150. Although not shown in FIG. 8, the yarn carrier structure 150 is preferably provided with positioning slots and the other yarn and tool handling features of the embodiment of FIGS. 1 and 3.

As can be appreciated, the present invention provides a yarn carrier structure well-suited for machine manipulation in automated textile systems by which the yarn ends can be reliably retained in a known positional relationship relative to one another, by which the yarn carrier can be gripped or otherwise engaged by a machine tool, and by which the yarn carrier can be mounted in a predetermined alignment on a mounting structure.

Thus it will be appreciated from the above that as a result of the present invention, a highly effective yarn carrier structure is provided by which the principal objective, among others, is completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims and their legal equivalent.

What is claimed is:

1. A yarn carrier structure, comprising:

a yarn support body formed about a longitudinally extending axis and having an exterior surface upon which yarn is wound;

means for retaining at least a first yarn end in a predetermined location; and engagement surface means having a predetermined and angularly fixed positional relationship about the axis relative to the yarn end retaining means for permitting the yarn support body to be engaged and to consequently fix the location and angular relationship of the retaining means and a yarn end there retained relative to the engagement surface means.

2. The yarn carrier structure of claim 1, wherein the exterior surface is defined as a surface of revolution about the longitudinal axis, the yarn support body having an axially extending interior opening defined by first and second engagement surfaces which comprise the engagement surface means.

3. The yarn carrier structure of claim 2, wherein the first and second engagement surfaces are opposed to one another.

4. The yarn carrier structure of claim 2, wherein the interior opening has a polygonal cross section in a plane transverse to the axis, at least two sides thereof defining said first and second engagement surfaces.

5. The yarn carrier structure of claim 2, wherein the interior opening has trapezoidal cross section in a plane transverse to the axis, opposite surfaces thereof defining said first and second engagement surfaces.

6. The yarn carrier structure of claim 2, wherein the interior opening has a T-shaped cross section in a plane transverse to the axis, a first and a second surface thereof defining said first and second engagement surfaces.

7. A yarn carrier structure, comprising:

a yarn support body having an exterior surface of revolution defined about an axis and upon which yarn is wound;

means for retaining at least a first yarn end within the yarn support body; and engagement surface means for permitting engagement with the yarn support body, the surface means having a predetermined positional and angularly fixed relationship about the axis relative to the means for retaining to fix the angular position about the axis of the retaining means and a yarn end there retained with respect to the engagement surface means.

8. The yarn carrier structure of claim 7, wherein the means for retaining comprises a yarn entry port communicating with an internal cavity formed within the yarn support body for receiving at least a first yarn end, the entry port having a predetermined positional relationship relative to the engagement surface means.

9. The yarn carrier structure of claim 7, wherein the means for retaining comprises a yarn entry port communicating with an internal passage formed within the yarn support body for receiving at least a first yarn end, the entry port having a predetermined positional relationship relative to the engagement surface means.

10. The yarn carrier structure of claim 9, further comprising a hollow elongated tube in communication with the yarn entry port and defining the internal passage.

11. The yarn carrier structure of claim 9, wherein the passage extends in the axial direction of the yarn support body.

12. The yarn carrier structure of claim 9, wherein the passage has a path length greater than the axial length of the yarn support body.

13. The yarn carrier structure of claim 9, wherein the yarn support body includes a yarn exit opening communicating with the passage.

14. The yarn carrier structure of claim 13, wherein the yarn entry port is at a first end of the yarn support body and the yarn exit opening is at the opposite end thereof.

15. The yarn carrier structure of claim 9, wherein at least a portion of the passage extends along a helical path formed about the axis of the yarn support body.

16. The yarn carrier structure of claim 14, wherein the passage extends between the yarn entry port and the yarn exit opening in both a first and a second axial direction.

17. The yarn carrier structure of claim 7, further comprising:

mounting surface means for mounting the yarn support body on a mounting structure.

18. The yarn carrier structure of claim 17, wherein the mounting surface means comprises first and second slots formed in the yarn support body.

19. The yarn carrier structure of claim 18, wherein the first and second slots are formed along parallel chords in a common plane transverse to the axis of the yarn support body.

20. The yarn carrier structure of claim 18, wherein the first and second slots are formed along non-parallel chords in a common plane transverse to the axis of the yarn support body.

21. The yarn carrier structure of claim 7, further comprising at least one releasable yarn engaging pad mounted on an exterior surface of the yarn carrier structure.

22. A yarn carrier structure, comprising:

a yarn support body having an exterior surface of revolution defined about an axis and upon which yarn is wound;

first means for receiving at least a first yarn end;

second means for receiving at least a second yarn end; and engagement surface means for permitting engagement with the yarn support body, the engagement surface means having a predetermined positional and angularly fixed relationship about the axis relative to the first and second means for receiving a yarn end to fix the respective angular relationship of the first and second means relative to the engagement surface means.

23. The yarn carrier structure of claim 22, wherein the first means for receiving includes a first entry port communicating with a first cavity formed within the yarn support body for receiving a first yarn end and a second entry port communicating with a second cavity formed within the yarn support body for receiving a second yarn end, the entry ports having a predetermined positional relationship relative to the engagement surface means.

24. The yarn carrier structure of claim 22, wherein the first means for receiving includes a first entry port communicating with a first passage formed within the yarn support body for receiving a first yarn end and a second entry port communicating with a second passage formed within the yarn support body for receiving a second yarn end, the entry ports having a predetermined positional relationship relative to the engagement surface means.

25. The yarn carrier structure of claim 24, further comprising a first and a second hollow elongated tube in communication with the first and the second yarn entry port and defining, respectively, the first passage and the second passage.

26. The yarn carrier structure of claim 24, wherein the first and second passages extend in the axial direction of the yarn support body.

27. The yarn carrier structure of claim 26, wherein the passages have a path length greater than the axial length of the yarn support body.

28. The yarn carrier structure of claim 24, wherein the yarn support body includes a first yarn exit opening communicating with the first passage and a second yarn exit opening communicating with the second passage.

29. The yarn carrier structure of claim 28, wherein the yarn entry ports are at a first end of the yarn support body and the yarn exit openings are at the opposite end thereof.

30. The yarn carrier structure of claim 24, wherein at least a portion of the first and second passages extend along respective helical paths formed about the axis of the yarn support body.

31. The yarn carrier structure of claim 24, wherein at least a portion of the first and second passages extend along respective adjacent helical paths formed about the axis of the yarn support body.

32. The yarn carrier structure of claim 28, wherein each of the first and second passages extend in both a first and a second axial direction between the yarn entry and yarn exit openings.

33. The yarn carrier structure of claim 24, further comprising:

mounting surface means for mounting the yarn support body on a mounting structure.

34. The yarn carrier structure of claim 33, wherein the mounting surface means comprises first and second slots formed in the yarn support body.

35. The yarn carrier structure of claim 34, wherein the first and second slots are formed along parallel chords in a common plane transverse to the axis of the yarn support body.

36. The yarn carrier structure of claim 34, wherein the first and second slots are formed along non-parallel chords in a common plane transverse to the axis of the yarn support body.

37. A yarn handling system, comprising:

a yarn carrier structure having:

(a) a yarn support body formed about a longitudinally extending axis and having an exterior surface upon which yarn is wound, (b) means for retaining at least a first yarn end in a predetermined location, and (c) engagement surfaces having a predetermined positional and angularly fixed relationship about the axis relative to the yarn end retaining means for permitting engagement with the yarn support body; and tooling means for engaging the engagement surface means to releasably grip the yarn support body with a known positional and angular relationship relative to the yarn end retaining means.

38. The yarn handling system of claim 37, wherein the exterior surface is defined as a surface of revolution about the axis, the yarn support body having an axially extending interior opening defined by first and second engagement surfaces which comprise said engagement surfaces, the tooling means having first and second relatively movable surfaces for releasably engaging the first and second engagement surfaces.

39. The yarn handling system of claim 38, wherein the first and second engagement surfaces are opposed to one another.

40. The yarn handling system of claim 38, wherein the interior opening has a polygonal cross section in a plane transverse to the axis, at least two sides thereof defining the first and second engagement surfaces.

41. The yarn handling system of claim 38, wherein the interior opening has a trapezoidal cross section in a plane transverse to the axis, opposite surfaces thereof defining the first and second engagement surfaces.

42. The yarn handling system of claim 38, wherein the interior opening has a T-shaped cross section in a plane transverse to the axis, a first and a second surface thereof defining said first and second engagement surfaces.

43. A yarn package mounting system, comprising:

a yarn support body having an exterior surface of revolution defined about a longitudinal axis and upon which yarn is wound to form a yarn package and a mounting surface means defining at least one positionally predetermined and angularly fixed reference surface relative the axis for mounting the yarn support body, the mounting surface means comprising a first slot formed in the yarn support body in a plane transverse to the longitudinal axis and a second slot formed in the yarn support body in a plane transverse to the longitudinal axis; and a mounting structure having means for engaging the reference surface of the mounting surface means to mount the yarn support body thereon.

44. The yarn package mounting system of claim 43, wherein the first and second slots are formed in a common plane transverse to the longitudinal axis of the yarn support body.

45. The yarn package mounting system of claim 44, wherein the first and second slots are formed along parallel chords in a common plane transverse to the longitudinal axis of the yarn support body.

46. The yarn package mounting system of claim 44, wherein the first and second slots are formed along non-parallel chords in a common plane transverse to the longitudinal axis of the yarn support body.

47. The yarn package mounting system of claim 46, wherein the mounting structure comprises a mounting plate having a thickness less than a width dimension of the first and second slots and an open-ended slot into which the yarn support body is inserted.

48. The yarn package mounting system of claim 47, further comprising:

means for retaining at least a first yarn end in a predetermined dimensional relationship relative to the mounting surface means.

49. The yarn package mounting system of claim 47, further comprising:

first means for receiving at least a first yarn end; and second means for receiving at least a second yarn end;

the first and second means positioned in a predetermined relationship relative to the mounting surface means.

50. A yarn carrier structure comprising:

inner and outer co-axial tubes, the outer tube having an exterior surface of revolution upon which yarn is wound;

annular spacer means mounted on the inner tube and upon which the outer tube is mounted;

at least one yarn entry port communicating with a passage between the inner and outer tubes for receiving at least one yarn end.

51. The yarn carrier of claim 50, further comprising a hollow, elongated tube communicating with the yarn entry port and defining the passage for receiving the at least one yarn end.

52. The yarn carrier of claim 51, further comprising a yarn exit opening communicating with the hollow, elongated tube.

53. The yarn carrier of claim 52, wherein the yarn entry port and the yarn exit opening are at opposite ends of the co-axial tubes.

54. The yarn carrier structure of claim 53, wherein the hollow, elongated tube has a path length greater than the axial length of the co-axial tubes.

55. The yarn carrier structure of claim 54, wherein at least a portion the hollow, elongated tube extends along a helical path formed about the axis of the yarn support body.

* * * * *